US005915598A

United States Patent [19]

Yazawa et al.

[11] Patent Number: 5,915,598

[45] Date of Patent: Jun. 29, 1999

[54] FLOW CONTROLLER FOR AEROSOL CONTAINER

[75] Inventors: Iwao Yazawa, Tokyo; Kazunori Hoshino, Kanagawa-ken, both of Japan

[73] Assignee: Toyo Aerosol Industry Co., Ltd., Tokyo, Japan

[21] Appl. No.: 09/035,414

[22] Filed: Mar. 5, 1998

[30] Foreign Application Priority Data

Nov. 7, 1997 [JP] Japan ..... 9-306094

[51] Int. Cl.[6] ..... B65D 83/14

[52] U.S. Cl. ..... 222/402.1; 222/402.22

[58] Field of Search ..... 222/394, 402.1, 222/402.22, 402.24

[56] References Cited

U.S. PATENT DOCUMENTS

| | | | |
|---|---|---|---|
| 3,520,450 | 7/1970 | Prussin et al. | 222/402.22 |
| 3,666,148 | 5/1972 | Webster | 222/402.22 |
| 4,393,984 | 7/1983 | Debard | 222/402.22 |
| 5,605,258 | 2/1997 | Abplanalp | 222/402.1 |

*Primary Examiner*—Philippe Derakshani
*Attorney, Agent, or Firm*—Kanesaka & Takeuchi

[57] ABSTRACT

In a flow controller mounted in a valve assembly for aerosol container, a stem body and a piston are inserted in a housing of the valve assembly in placing a spring between the stem body and the piston. The piston is formed with a controlling sleeve at a bottom of which an introduction hole for flowing the aerosol contents is opened in the piston. The controlling sleeve can enter into an insertion space formed between a cylinder formed at the stem body and an insertion member. Inner and outer round passageways capable of communicating with one another, are formed between the inner round surface of the controlling sleeve and the outer round surface of the insertion member and between the outer round surface of the controlling sleeve and the inner round surface of the cylinder, respectively. The controlling sleeve enters into the insertion space and changes communication resistance against the aerosol contents' flow according to the pressure of the aerosol contents, thereby maintaining a spray rate from the beginning to the last minute of spraying operation, as well as rendering the flow of the aerosol contents smooth and stable in making the whole assembly compact.

7 Claims, 11 Drawing Sheets

FLOW CONTROLLER FOR AEROSOL CONTAINER

BACKGROUND OF THE INVENTION

1. Field of the Invention

This invention relates to a flow controller for an aerosol container, used suitably for an aerosol product, like an aerosol product using a compression gas such as a carbonate gas or the like as a propellant, that otherwise tends to lose spraying pressure inside the aerosol container as aerosol contents are more sprayed.

2. Description of Related Art

Aerosol products have been categorized, based on a propellant, into products using liquefied gas and products using compression gas such as carbonate gas or the like. The aerosol products using liquefied gas as a propellant have a high expansion ratio of gas vaporization, and therefore, even if the aerosol contents are sprayed continuously for a considerable amount of time, the pressure in the aerosol container remains unchanged and is rarely reduced.

To the contrary, where a compression gas such as carbonate gas is used as a propellant in an aerosol container, the aerosol container can spray aerosol contents with a strong pressure at an initial stage of the use of the container. As the aerosol container sprays further aerosol contents, however, a headspace where the gas can exist becomes larger, thereby rendering the compression gas dispersed in the widened headspace, and reducing the pressure in the aerosol container. The spraying amount per unit time of the aerosol contents decreases in proportion to a decrease of the pressure in the aerosol container, thereby becoming subject to a large gap between the initial stage and later stage upon subsequent continuous use, rendering use of the aerosol container less satisfactory.

To eliminate such a problem, an invention was devised as disclosed in Japanese Unexamined Patent Publication (KOKAI) Heisei No.8-58,859. With this invention, a flow controller for controlling the flow amount of aerosol contents is arranged at a lower end of a valve assembly of an aerosol container or at a lower end of a dip tube connected to a valve assembly as a separate body from the valve assembly or the dip tube.

This conventional flow controller has a piston's controlling sleeve slidably inserted in a cylinder, and the flow amount of the aerosol contents is controlled by communication resistance occurring at a passage space formed between an inner round surface of the cylinder and an outer round surface of the controlling sleeve while the controlling sleeve is inserted. Where the aerosol container keeps a high pressure at an initial stage of spraying the aerosol contents, the piston is pushed toward an outlet side chamber by this pressure and slides to deeply insert the controlling sleeve. Since the communication resistance of the passage space becomes larger as the inner round surface of the piston faces to the outer round surface of the controlling sleeve with a larger area, the high pressure of the aerosol container results in a high communication resistance, thereby suppressing the flow amount of the aerosol contents.

To the contrary, where the aerosol contents are further sprayed and the headspace is made larger, the pressure in the aerosol container is made lower, thereby reducing the pressure onto the piston. The reduced pressure on the piston reduces an insertion amount of the controlling sleeve in the cylinder. According to this reduction of the insertion amount, the communication resistance of the passage space is reduced, thereby allowing the aerosol contents to pass more through the passage space. Thus, the flow controller controls the flow amount of the aerosol contents in proportion to the pressure in the aerosol container, thereby maintaining the spray amount of the aerosol contents per unit time at a constant amount.

With such a conventional flow controller, however, the flow controller is assembled as a separate body from the valve assembly, so that manufacturing of the flow controller is laborious and requires materials, resulting in high costs. Such a controller may also need a process to attach the controller to the dip tube. Where the controller is attached to the dip tube, weight of the flow controller may unexpectedly bend and break the dip tube when the aerosol container is tilted during use of the container.

As another conventional controller, an invention disclosed in Japanese Unexamined Patent Publication (KOKAI) Heisei No. 7-242,280, has a flow controller within a housing of a valve assembly. With this controller, a piston disposed on an inlet side chamber of the housing slides according to pressure in an aerosol container and compresses an elastic body disposed on an outlet side to restrict the flow amount of the aerosol contents passing through a bubble portion of the elastic body, thereby controlling the flow amount.

The controller incorporated in the housing may reduce labors and costs for the manufacturing process, in comparison with the art in Japanese Unexamined Patent Publication Showa No. 8-58,859. This controller, however, brings disfavored results in which the aerosol contents are in contact with the elastic body, thereby causing the elastic body to be impaired and to lose the elasticity, or thereby clogging the passages, and further this controller may encounter with loss of controllability of the flow amount.

SUMMARY OF THE INVENTION

It is an object of the invention, from a viewpoint to solve the problems above, to provide a flow controller in which aerosol contents are always sprayed at a constant amount per unit time even between at an initial state at which the pressure in an aerosol container is high and at a later stage at which the pressure is lowered.

It is another object of the invention to provide a flow controller in which a mechanism for controlling a flow amount is formed at a valve assembly to render the structure of an aerosol container simple and easy to be manufactured with minimum costs.

It is yet another object of the invention to provide a flow controller in which a spraying amount is surely controlled in preventing an aerosol container from spraying irregularly or pulsatively.

In one form of the invention, a flow controller for an aerosol container to which a valve assembly is secured at a top inner surface of a container body for containing aerosol contents, includes a housing cylindrically extending and having a hollow, a piston slidably placed inside the housing to divide the hollow of the housing into an inlet side chamber and an outlet side chamber for the aerosol contents with an introduction hole communicating between the inlet and outlet side chambers for the aerosol contents with respect to the piston and pushed by elastic force from a spring toward the inlet side chamber of the aerosol contents, a controlling sleeve cylindrically extending from the piston in the outlet side chamber and having a hollow, at a bottom of which the introduction hole is opened, a cylinder extending cylindrically from a stem body of the valve assembly, placed coaxially with and in opposition to the controlling sleeve, and an insertion member cylindrically extending inside and coaxially with the cylinder, placed to form, between an outer round surface of the insertion member and an inner round surface of the cylinder, a insertion space, which allows the controlling sleeve to slidably enter into the insertion space that forms an inner round passageway between an inner round surface of the controlling sleeve and the outer round surface of the insertion member and an outer round passageway between an outer round surface of the controlling sleeve and the inner round surface of the cylinder when the controlling sleeve enters the insertion space wherein the inner and outer round passageways are in communication of the aerosol contents with one another.

According to a preferred embodiment of the invention, the inner round passageway is formed of a groove axially extending on both or either of the outer round surface of the insertion member and the inner round surface of the controlling sleeve where the insertion member enters into the controlling sleeve in areal contact with the controlling sleeve. Alternatively, the inner round passageway is formed of a cylindrical clearance between the outer round surface of the insertion member and the inner round surface of the controlling sleeve. The outer round passageway is also formed of a groove axially extending on both or either of the outer round surface of the controlling sleeve and the inner round surface of the cylinder where the controlling sleeve enters into the cylinder in areal contact with the cylinder. Alternatively, the outer round passageway is formed of a cylindrical clearance between the outer round surface of the controlling sleeve and the inner round surface of the cylinder.

In a preferred embodiment, the stem body includes a cylindrical attachment member slidably inserted in the housing in areal contact with an inner round surface of the housing and an orifice through which the aerosol contents can be sprayed outside the aerosol container, and a groove axially extending on an outer round surface of the attachment member at the areal contact between the attachment member and the housing is formed in capable of communicating with the orifice of the stem body to form a passageway for the aerosol contents at a space between the inner round surface of the housing and the outer round surface of the stem body.

According to another embodiment of the invention, the stem body is capable of spraying the aerosol contents outside the aerosol container through an orifice of the stem body and includes a cylindrical attachment member slidably inserted in the housing in areal contact with an inner round surface of the housing, and the attachment member has a circumferential collar extending axially at an outer circumference of the attachment member to allow the aerosol content to flow through a passage bore formed in a top of the attachment member to the orifice of the stem body.

In one operational aspect of such preferred embodiments, when the aerosol contents are not sprayed, pressures in the inlet and outlet side chambers are equalized through the piston by the aerosol contents flow from the introduction hole. Therefore, by the pushing force of the spring placed between the stem body and the piston, the piston is urged toward the inlet side chamber of the aerosol contents while the stem body is urged toward the outside of the housing. Upon pushing down the stem body to spray the aerosol contents, the aerosol contents are sprayed out of the housing. This spraying operation reduces the pressure in the housing, thereby flowing the aerosol contents in the container body into the housing.

Then, the aerosol contents pushes the piston to slides the piston toward the outlet side chamber in the housing in opposing to the pushing force of the spring. At that time, when the pressure in the aerosol container is high, the piston is exerted with a high pressure. Therefore, the piston makes the controlling sleeve enter deeply in the insertion space created between the cylinder and the insertion member in opposition to the pushing back force of the spring. The aerosol contents, at the same time as this entry, flows from the inlet side chamber to the outlet side chamber of the housing through the introduction hole formed in the piston in passing through the inner and outer round passageways. The aerosol contents are then sprayed outside the container through the orifice.

The aerosol contents flowing through the inner and outer round passageways receive communication resistance by the entry of the controlling sleeve in the insertion space. This communication resistance becomes larger as a distance of the inner and outer round passageways becomes longer. Accordingly, this communication resistance suppresses the flow amount of the aerosol contents.

At the beginning of spraying operation, the aerosol container has a high pressure, and the controlling sleeve is deeply inserted in the insertion space, thereby making the distance of inner and outer round passageways longer. The aerosol contents flowing through the inner and outer round passageways therefore receive larger communication resistance, which suppresses the flow amount of the aerosol contents. To the contrary, when the aerosol contents are further sprayed out, a headspace in the aerosol container becomes large to reduce the inner pressure of the container. When the pressure of the aerosol container is reduced, the exerting force to the piston is also reduced. The piston, therefore, slides less toward the outlet side chamber in opposition to the pushing force of the spring, so that the controlling sleeve enters less in the insertion space. As a result, the distance inner and outer round passageways becomes shorter, thereby reducing the communication resistance given to the aerosol contents, so that a larger amount of the aerosol contents can readily communicate through the inner and outer round passageways. Accordingly, when the pressure of the propellant is lowered, a larger amount of the aerosol contents can be introduced onto the outlet side chamber through inner and outer round passageways.

Thus, at the beginning of spraying operation, the aerosol contents flowing through the long distance of the inner and outer round passageways, receive a large communication resistance. However, since communicating through the inner and outer round passageways with a high pressure, the aerosol contents flow at a flow amount per unit time, which has no substantial difference from the flow amount of the aerosol contents flowing through inner and outer round passageways with a low pressure under a low communication resistance at a later stage of spraying operation.

The inner and outer round passageways are formed in a U-turn shape made of the inner round surface and the outer round surface of the controlling sleeve and are communicated with each other. The inner and outer round passageways can therefore create a long passage even if the piston, the cylinder, and the insertion member are formed in a small size. The valve assembly incorporating this flow controller can be made compact, thereby making the structure of the aerosol container simple.

Thus, in the housing of the valve assembly, the flow amount of the aerosol content is regulated by controlling the insertion amount of the controlling sleeve of the piston in the cylinder, and therefore, the controller allows the contents to be sprayed well out of the container where the aerosol contents flow stably, in comparison with a controller using an elastic body as disclosed in Japanese Unexamined Patent Publication (KOKAI), Heisei No. 7-242,280. The flow controller according to the invention, also has an improved durability in comparison with the controller having the elastic body. According to the preferred embodiment, the flow controller is incorporated in the valve assembly, so that the structure of the aerosol container is made simpler and reduces the number of parts or working time for assembling the container, in comparison with a controller disclosed in Japanese Unexamined Patent Publication (KOKAI), Heisei No. 8-58,859.

The controlling sleeve moves back and forth in the insertion space formed between the inner round surface of the cylinder of the stem body and the outer round surface the insertion member, so that the sleeve can slide stably. The sleeve can therefore slide without pulsing or the like, and consequently, the flow amount per unit time can always be maintained stably at a constant amount.

In accordance with another embodiment, the inner round passageway can be formed of rectangularly U-shaped grooves axially extending on both or either of the outer round surface of the insertion member and the inner round surface of the controlling sleeve. By those grooves, the cross section of the inner round passageway for the aerosol contents becomes narrower, thereby greatly effectuating the communication suppression at the beginning of the aerosol container's use. The outer round passageway can be formed of rectangularly U-shaped grooves axially extending on both or either of the outer surface of the controlling sleeve and the inner surface of the cylinder. By this formation, the outer round passageway can obtain substantially the same effects as the inner round passageway having the rectangularly U-shaped grooves.

Alternatively, if the inner round passageway is formed of a cylindrical clearance placed between the outer round surface of the insertion member and the inner round surface of the controlling sleeve, molding or assembly of the controller becomes easy in comparison with the controller having the rectangularly U-shaped grooves. The cylindrical space makes the piston slide smoothly on the outer round surface of the insertion member, so that the propellant pressure in the aerosol container is surely transmitted to the slide of the piston. However, the piston may possibly suffer from pulsing movements due to the cylindrical clearance, because the piston is positioned less stably than a piston secured with an areal contact. Similarly, if the outer round passageway is formed of a cylindrical clearance placed between the outer round surface of the controlling sleeve and the inner round surface of the cylinder, the outer round passageway can also obtain the same technical effects as the inner round passageway of the cylindrical clearance.

In a stem body according to an embodiment, the outer round surface of the attachment member inserted in the housing is in slidable contact with the inner round surface of the housing, and grooves axially extending are formed at the contact portion as to be capable of communicating with the orifice of the stem body. A passage of the aerosol contents is formed at a space between the inner round surface of the housing and the outer round surface of the stem body, thereby capable of spraying the aerosol contents outside the container through the orifice. The stem body also can be formed with the outer circumferential collar having a rectangularly U-shaped cross section at an outer circumference of the attachment member inserted in the housing. The collar has the passage bore for the aerosol contents capable of communicating with the orifice of the stem body to render the aerosol contents capable of being sprayed outside the container through the orifice. The stem body, any of above stem bodies, can slide smoothly and stably because the outer round surface of the attachment member slides in areal contact with the inner round surface of the housing.

BRIEF DESCRIPTION OF THE DRAWINGS

The above and other objects and features of the invention are apparent to those skilled in the art from the following preferred embodiments thereof when considered in conjunction with the accompanied drawings, in which.

DETAILED DESCRIPTION OF THE PREFERRED EMBODIMENTS

Figure 1:
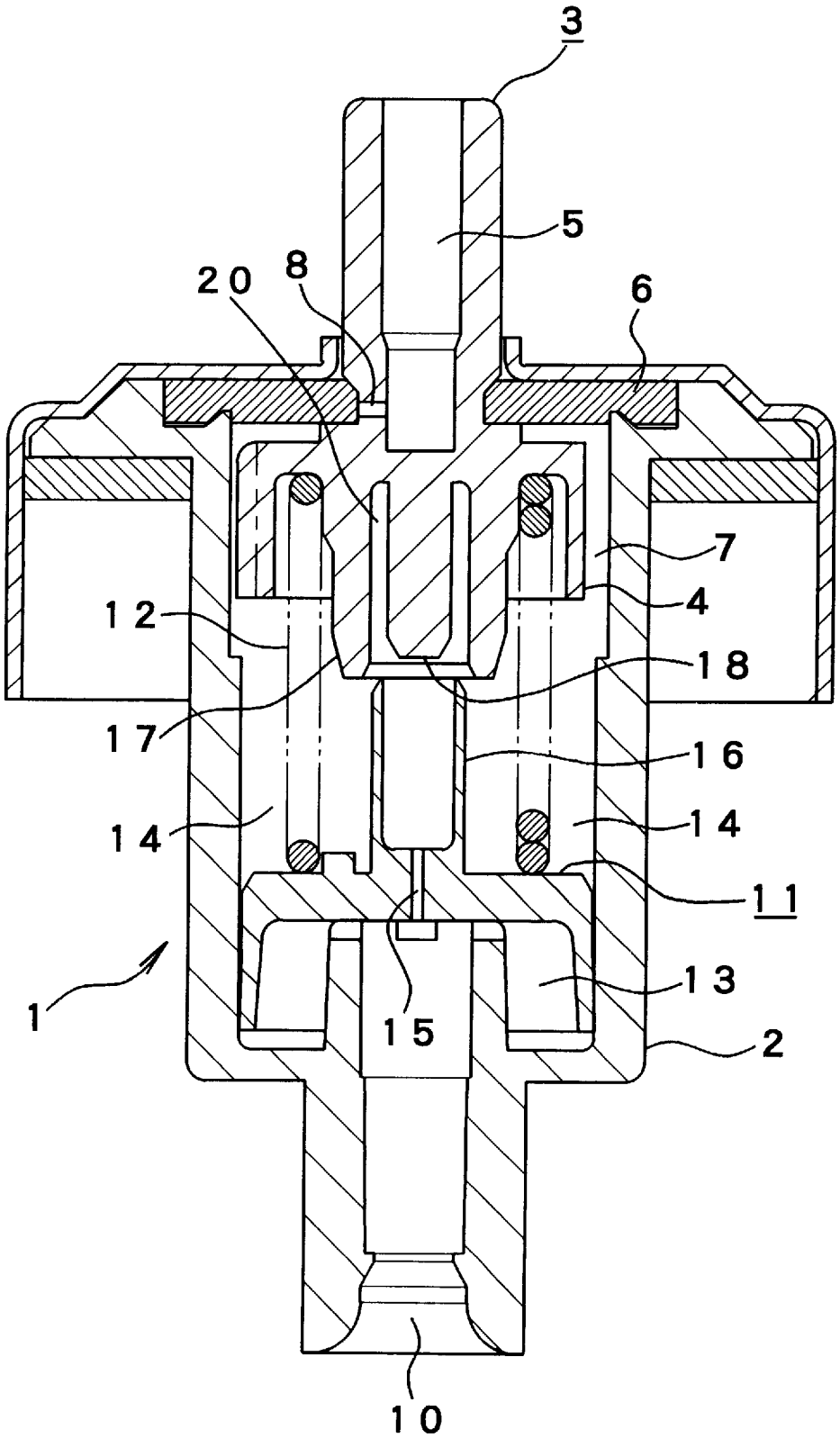
FIG. 1 is a cross section showing a flow controller, according to the invention, incorporated in a valve assembly of a compact aerosol container.

Referring to FIGS. 1 to 6, a flow controller according to the invention as a first embodiment is shown. Numeral 1 designates a valve assembly for an aerosol container. The valve assembly 1 has a structure that can be secured to a top end of a relatively compact container body, not shown, of a volume of 220 cc or less. An attachment member 4 of a stem body 3 is so inserted in a housing 2 of the valve assembly 1 as to be slidable on an inner surface of the housing 2. A spray path 5 of the stem body 3 is projected outwardly from a top face of the container body through a stem gasket 6.

Figure 5:
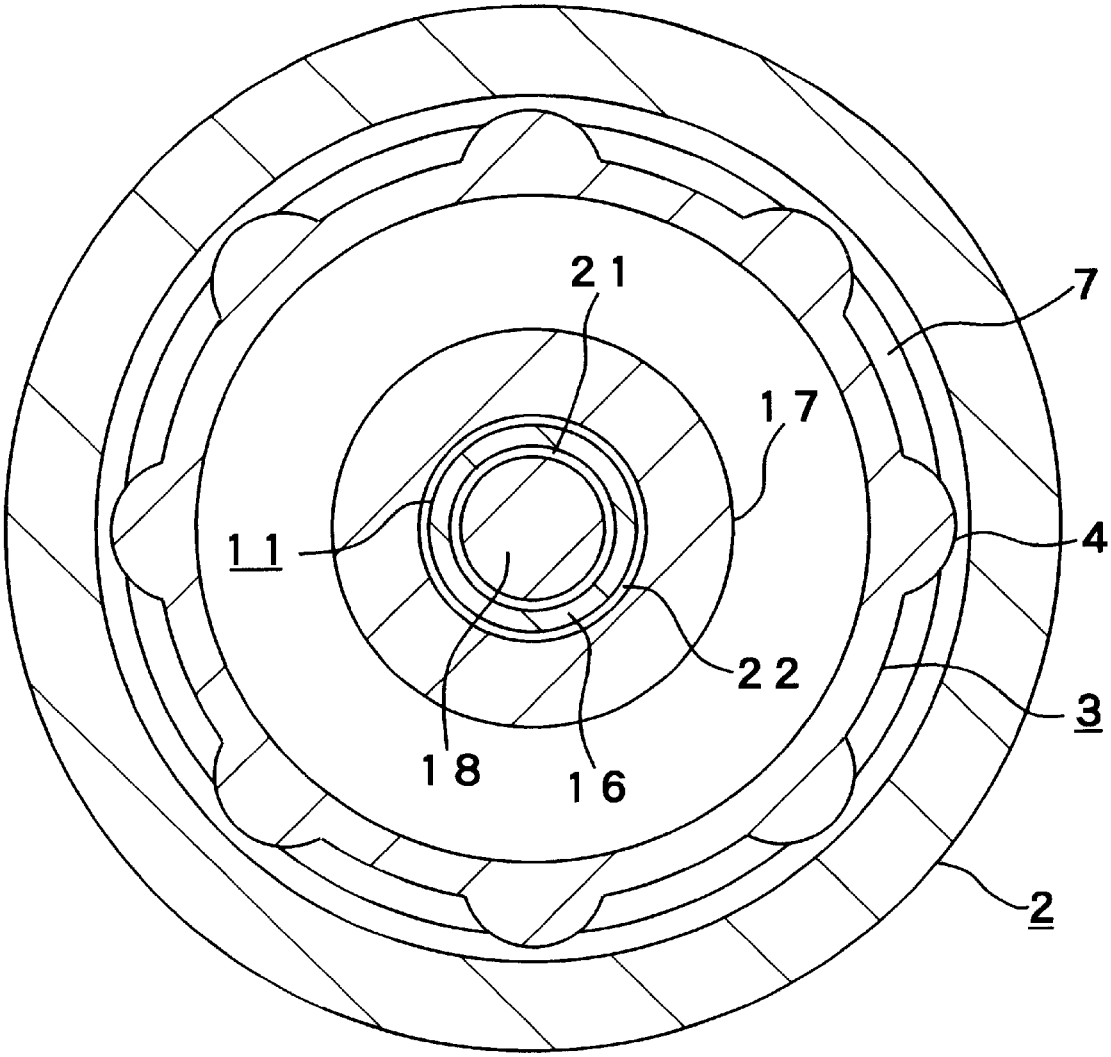
FIG. 5 is a cross section showing the flow controller, taken as indicated along the line A—A line of FIG. 3.
Figure 6:
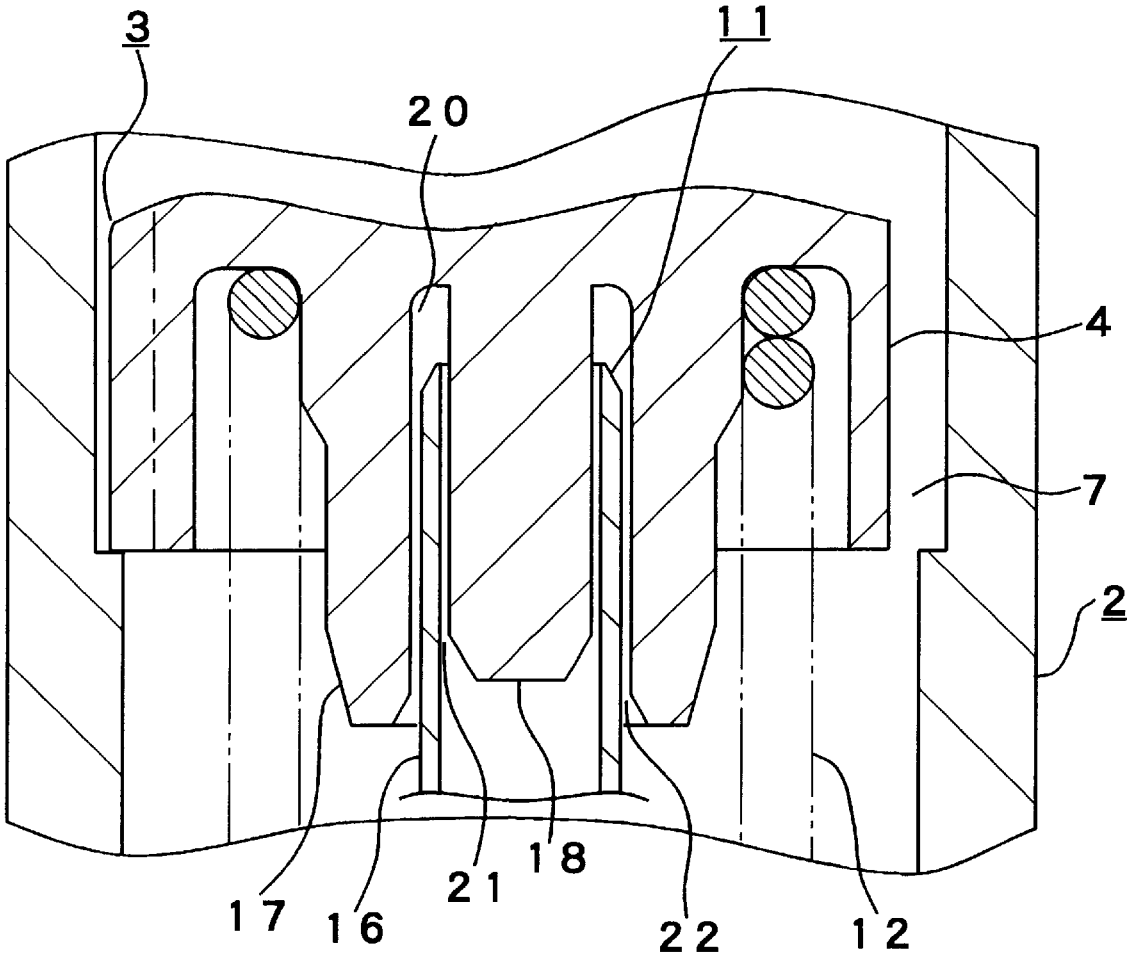
FIG. 6 is an enlarged view showing an essential portion in FIG. 3.

The attachment member 4 of the stem body 3 contacts with an inner round surface of the housing 2 by an outer round surface of the attachment member 4 and has at this contacting area a plurality of grooves each having a rectangularly U-shaped cross section and extending axially on the outer round surface of the attachment member 4, as shown in FIGS. 1, 5. These grooves form a passageway 7 for aerosol contents between the inner round surface of the housing 2 and the outer round surface of the attachment member 4. The passageway 7 is capable of communicating with an orifice 8 of the stem body 3 and can spray the aerosol contents in the housing 2 out of the container upon introducing the aerosol contents into the spray path 5 by way of the passageway 7 and the orifice 8.

A piston 11 is so inserted in the housing 2 as slidable in a direction of an inlet 10 of the aerosol contents. A compression spring 12 is placed between the piston 11 and the stem body 3. The elastic force of the compression spring 12 pushes the piston 11 toward the inlet 10 and pushes the stem body 3 toward an external direction of the housing 2. The piston 11 divides a hollow of the housing 2 into an inlet side chamber 13 and an outlet side chamber 14.

An introduction hole 15 is formed in the piston 11 to flow the aerosol contents from the inlet side chamber 13 to the outlet side chamber 14. The piston 11 has a cylindrical controlling sleeve 16, extending in a projecting manner from the piston 11 on the outlet side chamber 14, at a bottom of which the introduction hole 15 is opened. The controlling sleeve 16 is located as to oppose to a cylinder 17 formed on the stem body 3 disposed on the outlet side chamber 14. Meanwhile, a cylindrical insertion member 18 is formed as to project in an axial direction in the cylinder 17. An insertion space 20 is formed between an outer round surface of the insertion member and an inner round surface of the cylinder 17, allowing the controlling sleeve 16 of the piston 11 to slidably enter in the insertion space 20.

Figure 3:
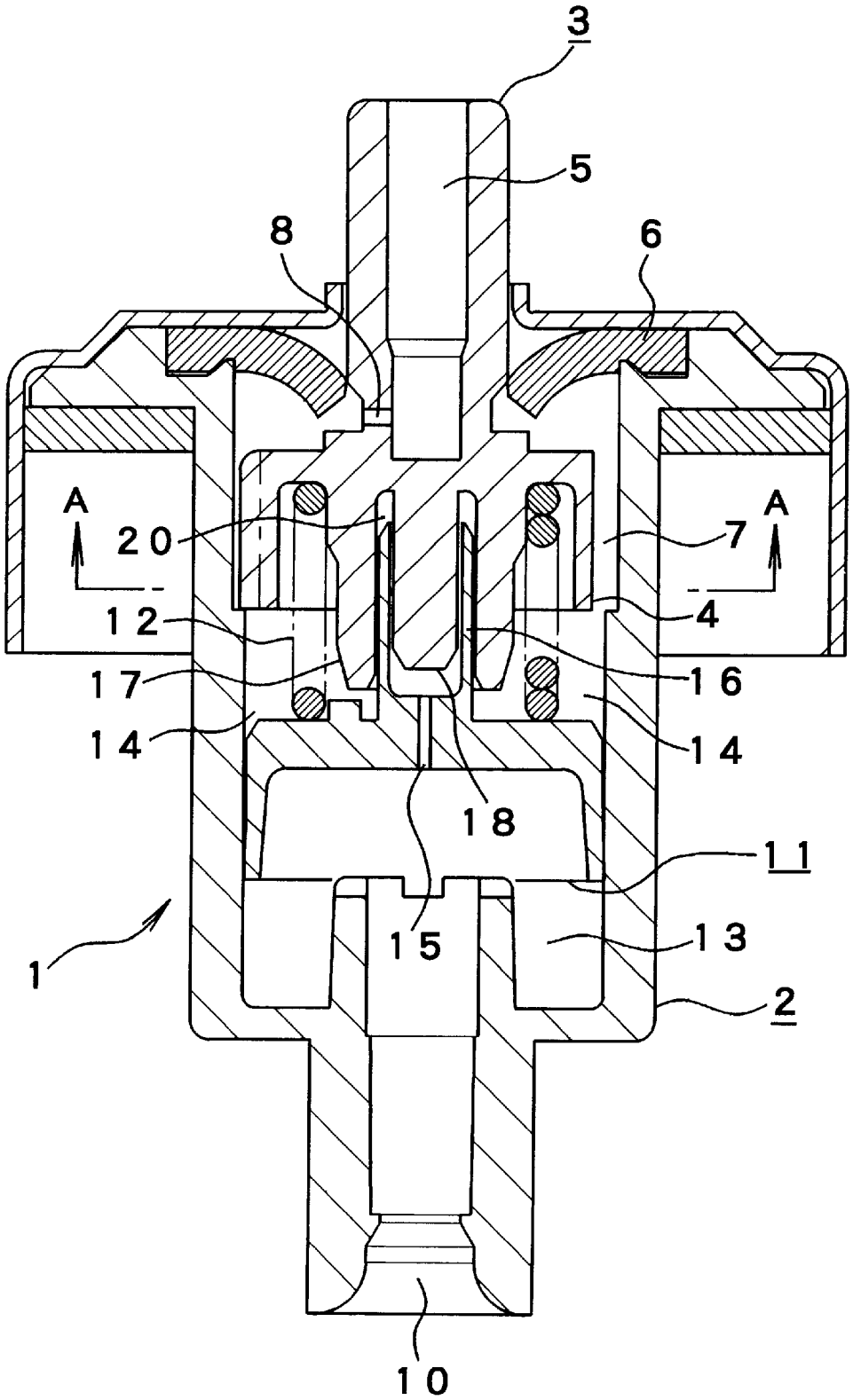
FIG. 3 is a cross section showing the flow controller in a situation that a controlling sleeve is deeply inserted in an insertion space by a high pressure of a propellant.

Each parts around insertion space 20 are designed to create cylindrical clearances, when the controlling sleeve 16 enters the insertion space 20, between the inner round surface of the controlling sleeve 16 and the outer round surface of the insertion member 18 and between the outer round surface of the controlling sleeve 16 and the inner round surface of the cylinder 17. Those cylindrical clearances make an inner round passageway 21 and an outer round passageway 22 for flowing the aerosol contents between the inner round surface of the controlling sleeve 16 and the outer round surface of the insertion member 18 and between the outer round surface of the controlling sleeve 16 and the inner round surface of the cylinder 17. As shown in FIG. 3, those parts are formed with sizes that, even if the controlling sleeve 16 deeply enters in the insertion space 20, a tip of the controlling sleeve 16 would not contact to a bottom of the insertion space 20, thereby rendering capable of communicating between the inner round passageway 21 and the outer round passageway 22 at any time.

The introduction hole 15 bored in the piston 11 is formed with a diameter of 0.3 mm to 1.0 mm and introduces the aerosol contents brought from the inlet 10 arranged at the lower end of the housing 2 into the housing 2 by giving a certain limitation to the contents. When the introduction hole 15 is formed with a diameter such that the flow amount of the aerosol contents is more than the spraying amount from the orifice 8, the pressure of the inlet side chamber 13 and the pressure of the outlet side chamber 14 are equalized to one another when the aerosol contents are sprayed, thereby hardly transferring the contents to the outlet side chamber 14 of the piston 11. Therefore, the diameter of the introduction hole 15 is so made smaller that the aerosol contents flows less than the spraying amount from the orifice 8 as described above, thereby preventing pressures of the inlet and outlet side chambers 13, 14 from equalizing to each other when the aerosol contents are sprayed.

In operation, aerosol contents pressurized by a propellant such as a carbonate gas or the like are filled in the container body for aerosol container in which the flow controller is incorporated as described above. When the aerosol contents are not sprayed, the aerosol contents brought from the introduction hole 15 makes equalized the pressures of the inlet and outlet side chambers 13, 14 by way of the piston 11. As shown in FIG. 1, therefore, the elastic force of the compression spring 12 pushes the piston 11 toward the inlet 10 of the aerosol contents and pushes the stem body 3 in the external direction of the housing 2.

Figure 2:
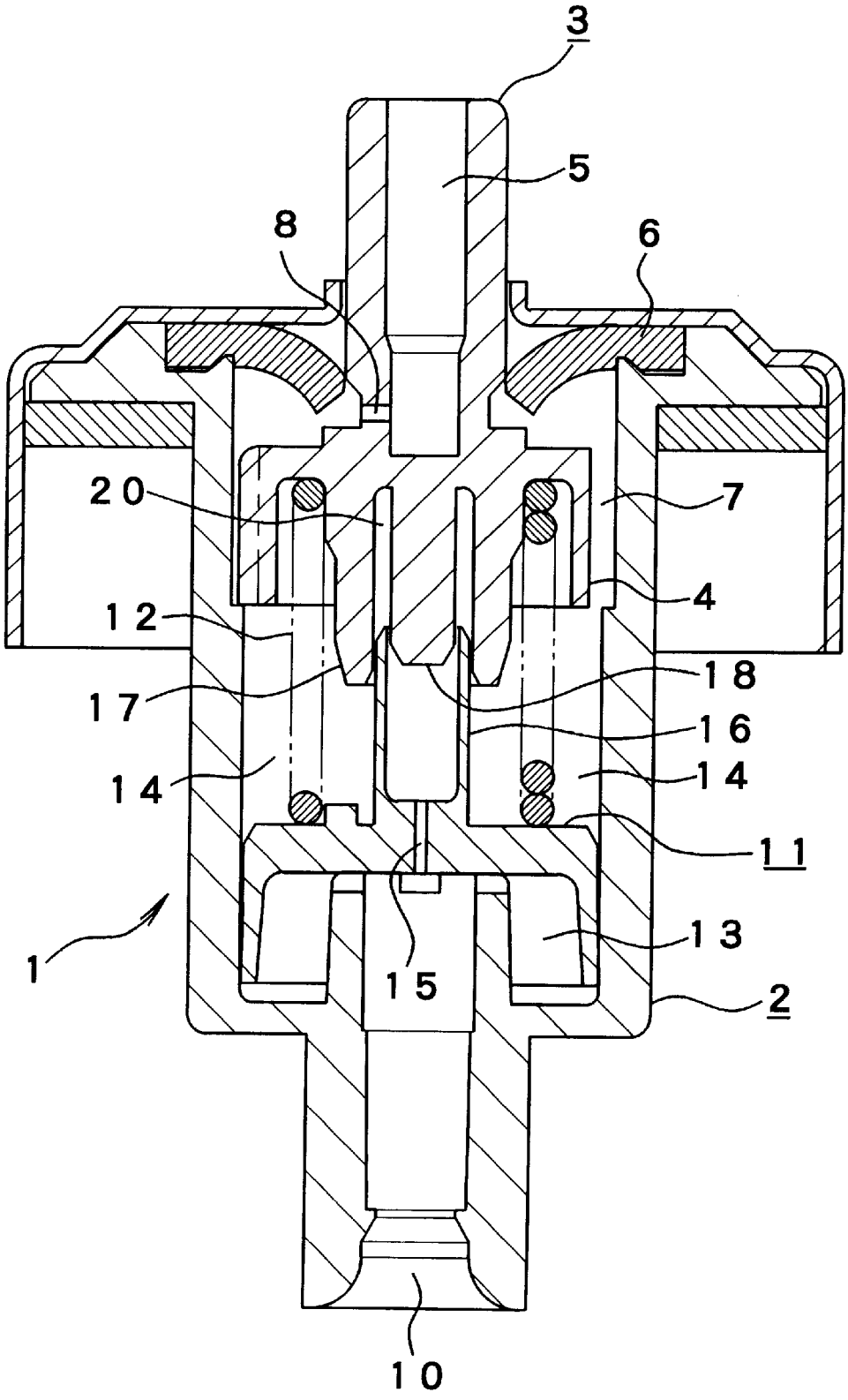
FIG. 2 is a cross section showing the flow controller in a situation that a stem body is pushed down to spray aerosol contents.

To spray the aerosol contents, the stem body 3 is pushed down, as shown in Fig.2, to open the valve at the orifice 8 of the valve assembly 1. The aerosol contents in the housing 2 are sprayed outside upon opening the valve, thereby lowering the pressure in the housing 2. The lowered pressure induces the aerosol contents to flow into the inlet side chamber 13 of the housing 2 through the inlet 10. The piston 11 slides toward the outlet side chamber 14 in the housing 2 in opposing to pushing back force of the compression spring 12 by pressure of the propellant for the aerosol contents that brought in the inlet side chamber 13. The controlling sleeve 16 of the piston 11 is inserted in the insertion space 20 formed of the cylinder 17 and the insertion member 18 by this slide.

At an initial stage, or at the beginning of use, when the pressure in the aerosol container is high, the propellant strongly pushes the piston, and therefore, as shown in FIG. 3, the piston 11 enters deeply in the insertion space 20 in opposing to the pushing back force of the compression spring 12 when the aerosol contents are sprayed. At the same time as this entry, the aerosol contents are flowed into the inner round passageway 21 from the introduction hole 15 bored in the piston 11 and try to reach the outlet side chamber 14 by passing through the inner round passageway 21 and the outer round passageway 22 while receiving communication resistance.

The communication resistance received by the aerosol contents increases or decreases in proportion to a distance of the inner round passageway 21 and the outer round passageway 22. If the controlling sleeve 16 deeply enters in the insertion space 20, the distance of the inner round passageway 21 and the outer round passageway 22 becomes longer, thereby increasing the communication resistance. The aerosol contents, therefore, flow through the inner round passageway 21 and the outer round passageway 22 in receiving this strong communication resistance, and reach the outlet side chamber 14 with high pressure though receiving suppression to the flow amount.

The aerosol contents having flowed out in the outlet side chamber 14 then pass through the passageway 7 arranged at the outer round surface of the attachment member 4 and flow into the spray path 5 of the stem body 3. The aerosol contents are subsequently sprayed out of the container.

Figure 4:
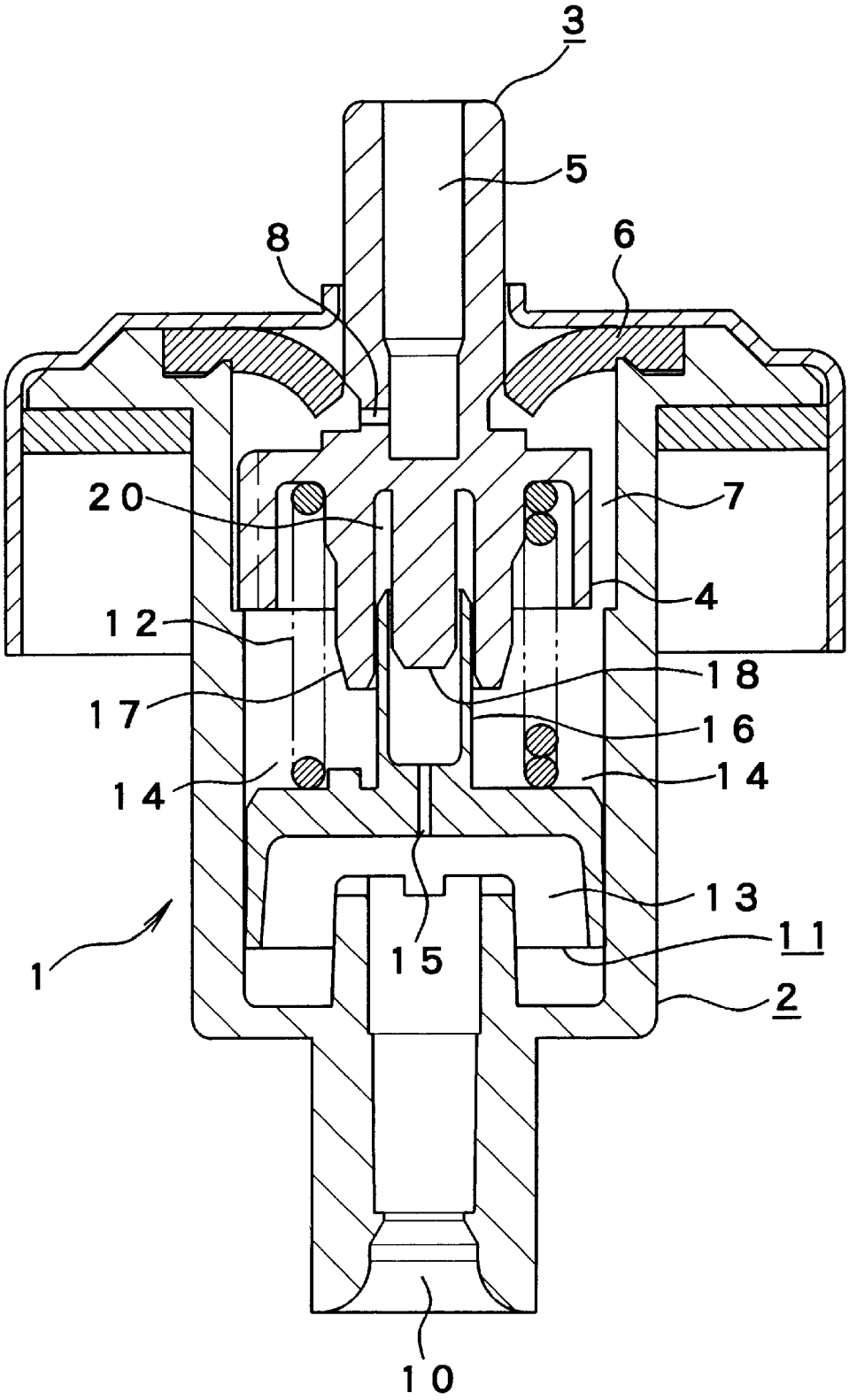
FIG. 4 is a cross section showing the flow controller in a situation that the inside of the aerosol container indicates a low pressure upon continuous spray of the aerosol contents.

Spraying operation of the aerosol contents makes larger the headspace in the container body and reduces the inner pressure of the container. The pressure exerted to the piston 11 from the inlet side chamber 13 is also reduced consequently. According to this reduced pressure, the pushing back force of the compression spring 12 pushes back the piston 11 toward the inlet side chamber 13, and as shown in FIG. 4, the controlling sleeve 16 is less inserted in the insertion space 20. Since the distance of the inner round passageway 21 and the outer round passageway 22 is shortened, the communication resistance that the aerosol contents receive while flowing through the inner round passageway 21 and the outer round passageway 22 is made smaller and therefore capable of increasing the flow amount of the aerosol contents. The flow amount increases where the pressure of the propellant is lowered, thereby making the flow amount per unit time the same level in comparison with the sprayed amount where the flow amount is suppressed though highly pressurized as described above.

Thus, the controlling sleeve 16 is less inserted in the insertion space 20 according to the spray pressure made smaller as the aerosol contents are more sprayed, so that this flow controller can always maintain a constant spray amount per unit time. Since the inner round passageway 21 is formed on the inner round surface of the controlling sleeve 16 and the outer round passageway 22 is formed on the outer round surface of the controlling sleeve 16, and since those passageways 21, 22 are in communication with one another, a long communication distance of the aerosol contents can be earned even in a small volume. Therefore, a large communication resistance can be obtained, rendering the flow control effective and certain, and further rendering the structure of the valve assembly compact and simple.

Figure 7:
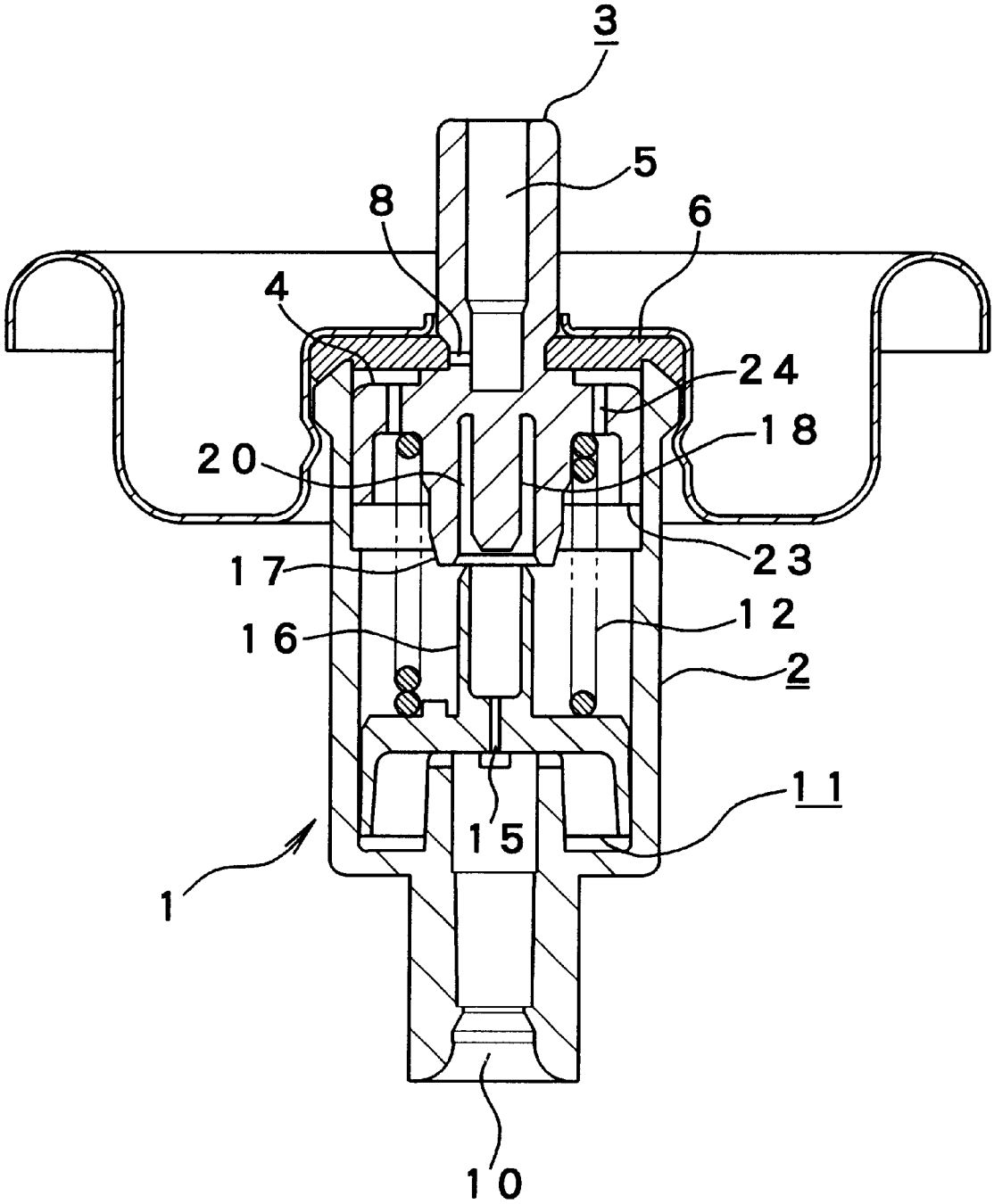
FIG. 7 is a cross section showing a flow controller of a second embodiment formed in a valve assembly for a large size aerosol container.

Although in the first embodiment thus described the valve assembly 1 having the flow controller according to the invention is used for a relatively compact aerosol container, the valve assembly can be used for a large aerosol container as shown in FIG. 7, indicated as a second embodiment. Moreover, although in the first embodiment the passageway 7 for aerosol contents is formed by forming the grooves axially extending on the outer round surface of the attachment member 4 of the stem body 3, in the second embodiment the stem body 3 has a circumferential collar 23 having a rectangular U-shaped cross section as an outer circumferential face of the attachment member 4 inserted in the housing 2 as shown in FIG. 7, and a passage bore 24 for the aerosol contents is opened at the circumferential collar 23 as to be capable of communicating with the orifice 8 of the stem body 3. The aerosol contents flowed in the outlet side chamber 14 of the housing 2 upon flowing through the inner round passageway 21 and the outer round passageway 22 are further flowed to the orifice 8 though the passage bore 24 and sprayed from the spray path 5 to the outside of the container through the orifice 8.

According to the first and second embodiment of the invention, the inner round passageway 21 is formed of the cylindrical clearance positioned between the outer round surface of the insertion member 18 and the inner round surface of the controlling sleeve 16, and the outer round passageway 22 is formed of the cylindrical clearance positioned between the outer round surface of the controlling sleeve 16 and the inner round surface of the cylinder 17. Those passageways 21, 22 can be readily formed, and the piston 11 can slide smoothly because the cylindrical space exists between the controlling sleeve 16 and the insertion space 20, thereby surely transmitting the pressure of the propellant in the aerosol container to the piston for sliding the piston.

Figure 8:
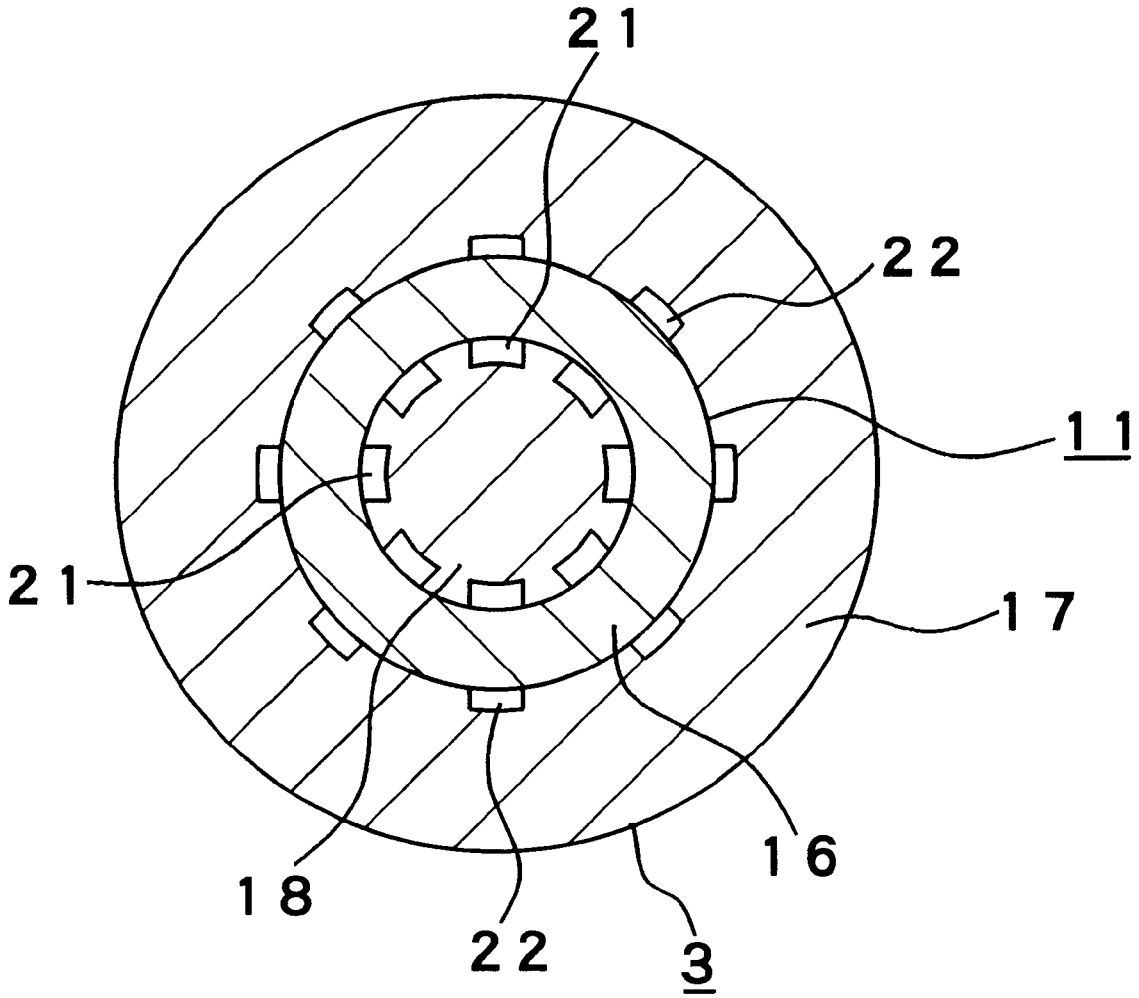
FIG. 8 is a cross section showing a flow controller of a third embodiment in which inner and outer round passageways are formed of grooves.

As shown in FIG. 8 as a third embodiment, the insertion member 18 can be formed to slide in the controlling sleeve 16 in areal contact with the controlling sleeve 16, and the inner round passageway 21 can be formed by rectangularly U-shaped grooves axially extending on the outer surface of the insertion member 18. The outer round passageway 22 can be formed of rectangularly U-shaped grooves axially extending on the inner round surface of the cylinder 17 where the controlling sleeve 16 can slide in the cylinder 17 in areal contact with the cylinder 17. This structure makes the inner round passageway 21 and the outer round passageway 22 narrower in comparison with the structure having the cylindrical spaces, thereby effectuating greatly to suppress the flow amount at the beginning of use of the aerosol container. Although in FIG. 8 the rectangularly U-shaped grooves for the inner round passageway 21 are formed only on the insertion member 18, the grooves can be formed on the inner surface of the controlling sleeve 16 or both of the controlling sleeve 16 and the insertion member 18. Similarly, although in FIG. 8 the rectangularly U-shaped grooves for the outer round passageway 22 are formed only on the cylinder 17, the grooves can be formed on the outer surface of the controlling sleeve 16 or both of the controlling sleeve 16 and the cylinder 17.

Figure 9:
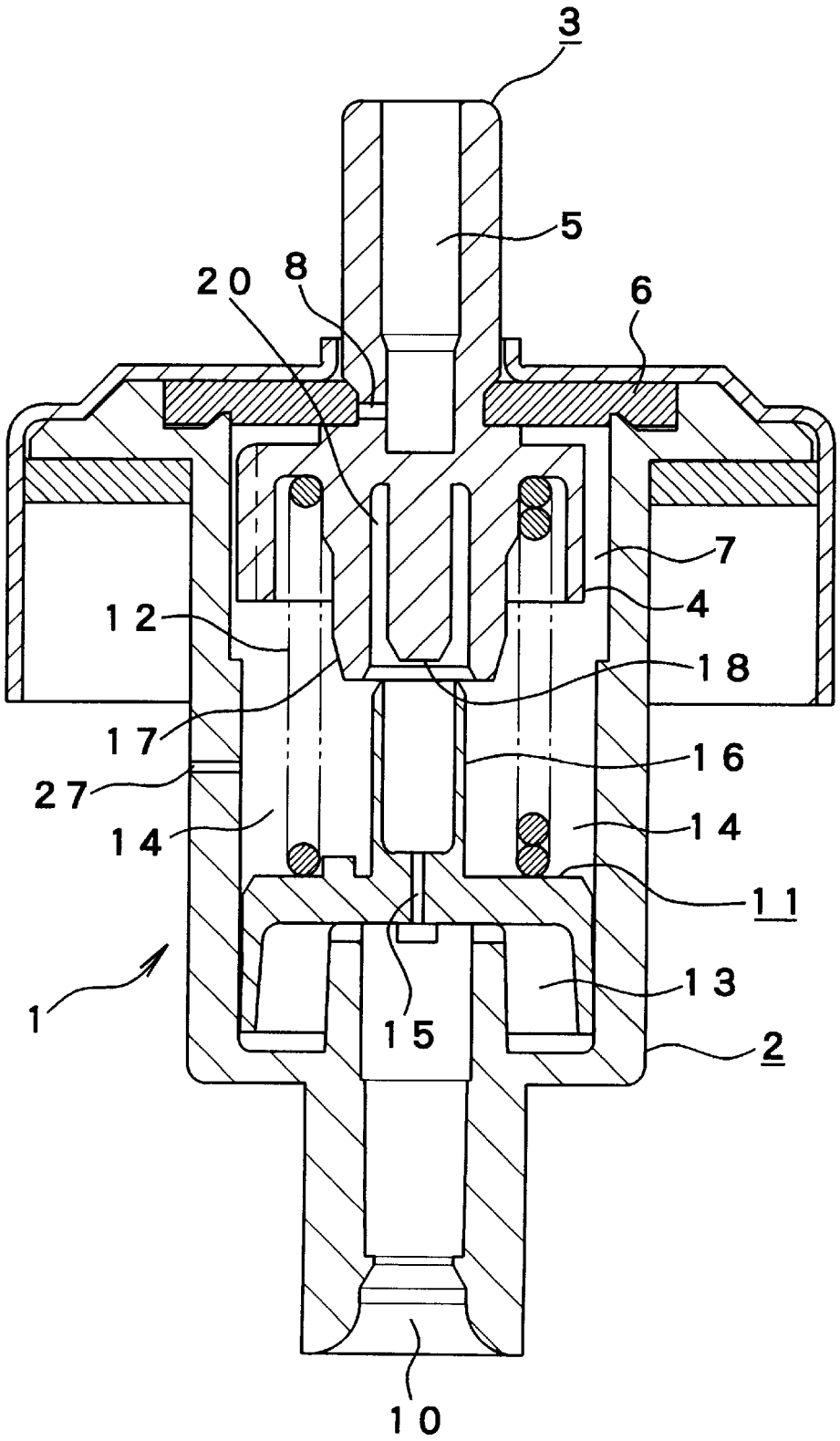
FIG. 9 is a cross section showing a flow controller of a fourth embodiment incorporated in a valve assembly in which a vapor tap is formed on a side face of an outlet side chamber of a housing.

In a fourth embodiment shown in FIG. 9, a flow controller is formed in the valve assembly 1 in which a vapor tap 27 is formed in a side face of the outlet side chamber 14 of the housing 2. When the aerosol contents are sprayed out, the aerosol contents flow into the outlet side chamber 14 of the housing 2 by the introduction hole 15, and a propellant flows into the chamber by the vapor tap 27, so that spraying contents are made into micro-particles. The total flow amounts of the vapor tap 27 and the introduction hole 15 are designed smaller than the spray amount from the orifice 8. That is, if the vapor tap 27 and the introduction hole 15 are formed with sizes such that the flow amounts exceed the spray amount from the orifice 8, the pressures in the inlet and outlet side chambers 13, 14 are equalized, thereby making hard the travel of the piston 11 toward the outlet side chamber 14. Accordingly, the introduction hole 15 and the vapor tap 27 have to be formed with sizes such that the flow amounts of the aerosol contents into the outlet side chamber 14 is made less than the spray amount from the orifice 8.

Figure 10:
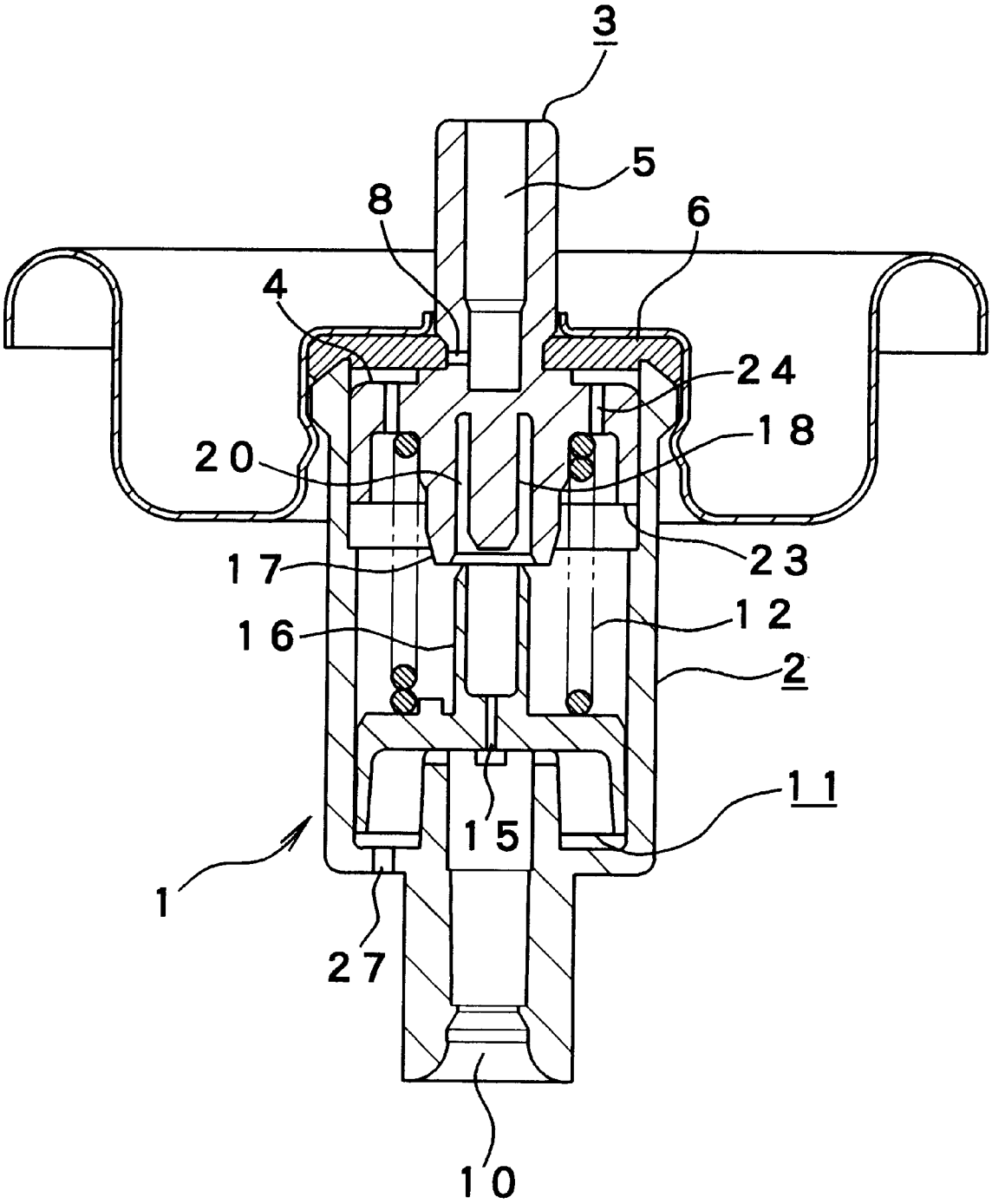
FIG. 10 is a cross section showing a flow controller of a fifth embodiment incorporated in a valve assembly in which a vapor tap is formed at a lower end of a housing.

Although in the fourth embodiment, the vapor tap 27 is formed in the side face of the outlet side chamber 14 of the housing 2, in a fifth embodiment, as shown in FIG. 10, the vapor tap 27 is formed at the inlet side chamber 13 of the housing 2. With this structure, the propellant flows into the inlet side chamber 13 by the vapor tap 27 and gives a high pressure on the piston 11 for directing the piston toward the outlet side chamber 14. Therefore, when the aerosol contents are sprayed, the pressures on the inlet and outlet side chambers 13, 14 are not equalized.

Figure 11:
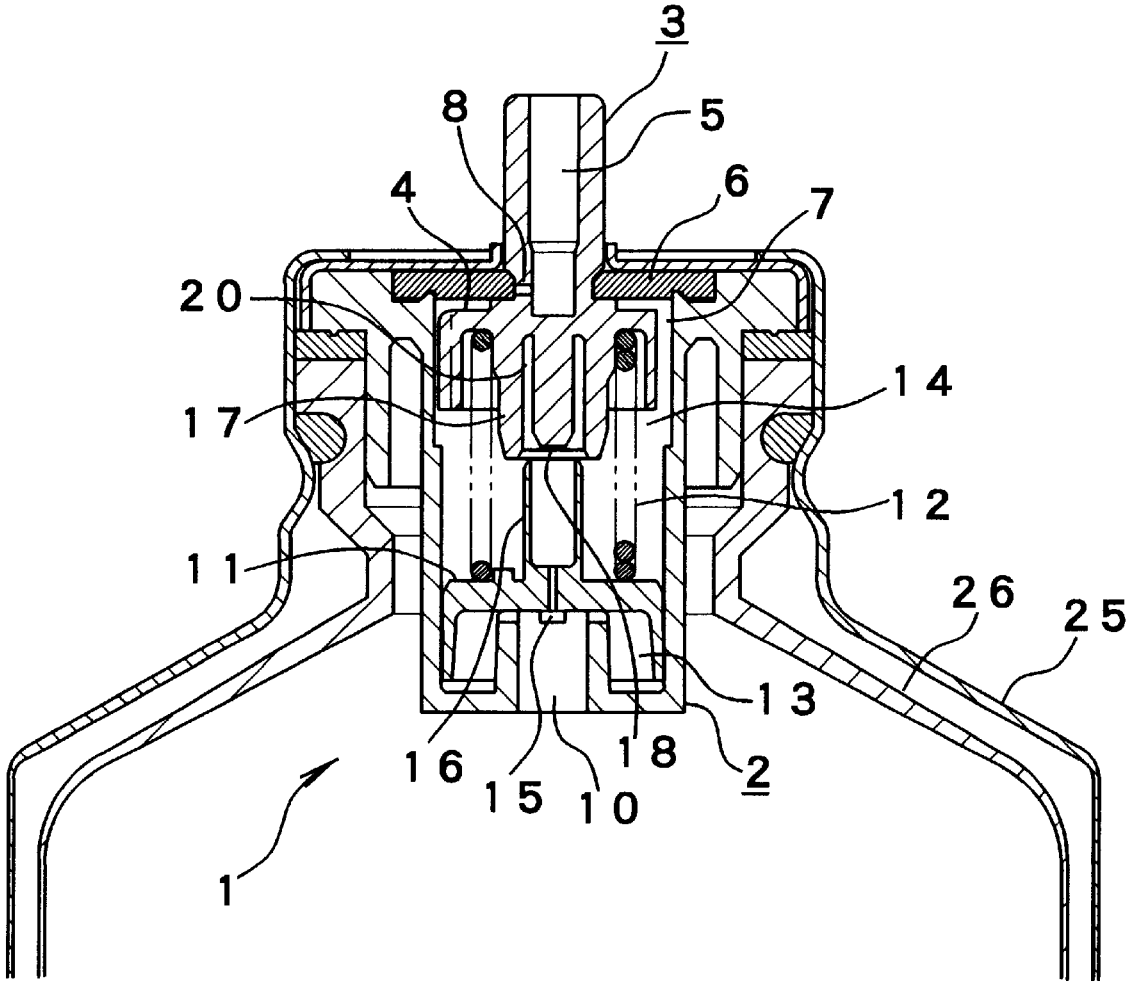
FIG. 11 is a cross section showing a flow controller of a sixth embodiment in which the flow controller is formed in a valve assembly for a double aerosol container.

Although in the respective embodiments the contents and the propellant are mixed in the aerosol container, in a sixth embodiment, as shown in FIG. 11, the valve assembly 1 having a flow controller according to the invention is made of a double aerosol container constituted of an outer container 25 and an inner container 26. The outer container 25 is filled with the propellant, while the inner container 26 is filled with contents, thereby separating the contents and propellant from each other. At the initial stage of spraying the contents, the propellant in the outer container 25 has a high pressure and exerts a strong pressure to the inner container 26. This pressure makes the contents flow much into the housing 2, strongly pushes the piston 11 toward the outlet side chamber 14, and deeply inserts the controlling sleeve 16 into the insertion space 20. As the contents in the inner container 26 become less, the headspace in the outer container 25 becomes larger, and therefore, the pressure in the outer container 25 is reduced, thereby weakening the pressure exerted to the inner container 26. As a result, the contents' pushing force exerted to the piston becomes less, and the insertion amount of the controlling sleeve 16 into the insertion space 20 becomes less, so that the flow amount of the contents can be maintained at the same level at the beginning of spraying as well as at the end of spraying.

With the second to sixth embodiments, the flow controller can maintain a constant spray amount of the contents per unit time at any time from the beginning to the last time of spraying and make an effective flow controller, by controlling the insertion amount of the piston 11 in proportion to the pressure of the aerosol contents.

The following examples in respective Tables are of respective aerosol contents in the case where the aerosol container having the flow controller thus described is filled with hair preparations, cosmetics, deodorants, other body treatments, insecticides, goods for household, etc.

As hair preparations, exemplified are a hair spray, a hair treatment, a tonic, and a hair restorer.

| Hair Spray | | |
|---|---|---|
| Acrylic resin alkanol amine liquid (30%) | 4.00 | weight % |
| Polyoxyethylene oleyl ether | 0.01 | weight % |
| Triethanol amine | 0.50 | weight % |
| Perfume | 0.17 | weight % |
| 99% denatured alcohol | 92.32 | weight % |
| Carbonate gas | 3.00 | weight % |
| Total | 100.00 | weight % |
| **Hair Treatment** | | |
| Liquid paraffin | 1.50 | weight % |
| Propylene glycol | 0.20 | weight % |
| Methyl phenol polysiloxane | 0.10 | weight % |
| Perfume | 0.20 | weight % |
| 99% denatured alcohol | 95.00 | weight % |
| Carbonate gas | 3.00 | weight % |
| Total | 100.00 | weight % |
| **Hair tonic** | | |
| Tocopherol acetate | 0.05 | weight % |
| Polyoxyethylene setting castor oil | 0.01 | weight % |
| L-menthol | 0.28 | weight % |
| d1-camphor | 0.05 | weight % |
| Tincture of pepper | 0.05 | weight % |
| Lactic acid | 0.02 | weight % |
| Perfume | 0.20 | weight % |
| 95% denatured alcohol | 57.00 | weight % |
| Ion-exchanged water | 41.65 | weight % |
| Nitrogen | 0.40 | weight % |
| Total | 100.00 | weight % |
| **Hair restorer** | | |
| Salicylic acid | 0.30 | weight % |
| Tocopherol acetate | 0.05 | weight % |
| Essence of Japanese green gentian | 0.20 | weight % |
| L-menthol | 0.05 | weight % |
| Concentrated glycerol | 1.00 | weight % |
| 95% denatured alcohol | 60.00 | weight % |
| Ion-exchanged water | 38.00 | weight % |
| Nitrogen | 0.40 | weight % |
| Total | 100.00 | weight % |

As cosmetics, exemplified are eau de Cologne, sunscreen, and shaving cream.

| Eau de Cologne | | |
|---|---|---|
| Dimethyl polysiloxane | 0.70 | weight % |
| POE glycerol triisostearate | 1.00 | weight % |
| Perfume | 2.00 | weight % |
| Polyoxyethylene setting caster oil (E.O. 60) | 1.00 | weight % |
| Ion-exchanged water | 35.00 | weight % |
| 99% denatured alcohol | 59.80 | weight % |
| Nitrogen | 0.50 | weight % |
| Total | 100.00 | weight % |

-continued

| Sunscreen | | |
|---|---|---|
| Cetyl octanate | 0.30 | weight % |
| Benzophenone-3 | 0.05 | weight % |
| Tocopherol acetate | 0.20 | weight % |
| Octyl methoxycinnamate | 0.05 | weight % |
| Mineral Oil | 60.00 | weight % |
| Carbonate gas | 38.00 | weight % |
| Total | 100.00 | weight % |
| **Shaving cream (shave gel later foaming)** | | |
| Palmitic Acid | 10.00 | weight % |
| Dibuthyl hydroxytoluene | 0.10 | weight % |
| Oleyl alcohol | 1.00 | weight % |
| Glycerol | 5.00 | weight % |
| Sorbitol liquid (70%) | 5.00 | weight % |
| Hydroxyethyl cellulose | 0.50 | weight % |
| Triethanol amine | 6.50 | weight % |
| Preservatives | 0.20 | weight % |
| Dye | Proper amount | |
| Isopentane/isobutane | 0.35 | weight % |
| Ion-exchanged water | 67.70 | weight % |
| Hydroxyethyl cellulose | 0.50 | weight % |
| Total | 100.00 | weight % |

Providing that the shaving cream is a prescription for contents filling the inner container in the double aerosol container shown as the sixth embodiment. Nitrogen is contained as a propellant in the outer container.

The following example is a prescription of an antiperspirant-deodorant.

| Antiperspant - Deodorant | | |
|---|---|---|
| 2,4,4'-trichloro-2-hydroxy diphenyl ether | 0.20 | weight % |
| Octyl dodecanol | 1.00 | weight % |
| Zinc phenol sulfonic acid | 1.00 | weight % |
| Perfume | 0.20 | weight % |
| 99% denatured alcohol | 94.60 | weight % |
| Carbonate gas | 3.00 | weight % |
| Total | 100.00 | weight % |

The following examples are prescriptions of a muscular antiphlogistic, and an insect repellent as other body treatment goods.

| Muscular antiphlogistic | | |
|---|---|---|
| L-menthol | 3.00 | weight % |
| Methyl salicylate | 2.70 | weight % |
| Tocopherol acetate | 0.20 | weight % |
| 99% denatured alcohol | 91.10 | weight % |
| Carbonate gas | 3.00 | weight % |
| Total | 100.00 | weight % |
| **Insect repellent** | | |
| N,N-diethyl-m-toluamide | 4.00 | weight % |
| Di-N-propyl-isocinchomeronate | 1.00 | weight % |
| N-(2-ethyl hexyl)-bicyclo 2.2.1-hepta-5-en-2.3-dicarboxyimide | 2.00 | weight % |
| Polyoxyethylene glycol #400 | 1.50 | weight % |
| 99% denatured alcohol | 88.50 | weight % |
| Carbonate gas | 3.00 | weight % |
| Total | 100.00 | weight % |

The following examples are prescriptions of an insecticide for cockroach and an insecticide for gardening.

| Insecticide for cockroach | | |
|---|---|---|
| O,O-dimethyl-O-(3-methyl-4-nitrophenyl) thiophosphate | 1.25 | weight % |
| Piperonyl butoxide | 1.95 | weight % |
| Perfume | 0.01 | weight % |
| Kerosine | 93.79 | weight % |
| Carbonate gas | 3.00 | weight % |
| Total | 100.00 | weight % |
| Insecticide for gardening | | |
| (1,3,4,5,6,7-hexahydro-1,3 dioxo-2-isoindolyl) methyl-d1-cis/trans-chrysanthemate | 0.20 | weight % |
| Polyoxyalkyl phosphate | 0.20 | weight % |
| Isopropyl alcohol | 4.00 | weight % |
| Ion-exchanged water | 95.30 | weight % |
| Nitrogen | 0.30 | weight % |
| Total | 100.00 | weight % |

The following examples are prescriptions of a deodorant for garbage and a waterproofing spray

| Deodorant for garbage | | |
|---|---|---|
| Lauric methacrylate | 2.00 | weight % |
| Isopropyl methylphenol | 0.20 | weight % |
| Hinokitiol | 0.01 | weight % |
| Dipropylene glycol | 0.90 | weight % |
| Perfume | 1.00 | weight % |
| 99% denatured alcohol | 92.89 | weight % |
| Carbonate gas | 3.00 | weight % |
| Total | 100.00 | weight % |
| Waterproofing spray | | |
| Fluororesin | 1.20 | weight % |
| Methyl polysiloxane | 2.50 | weight % |
| Hexylene glycol | 5.00 | weight % |
| 99% denatured alcohol | 88.30 | weight % |
| Carbonate gas | 3.00 | weight % |
| Total | 100.00 | weight % |

The flow controller thus constituted can always maintain the spray amount of the aerosol contents per unit time at the same level from the beginning to the last minute of spraying. When the spray amount is controlled, the piston is free from pulsation or the like, and the controller can regulate the flow amount stably. The flow controller is incorporated in the valve assembly, which renders the structure of the aerosol container simple, thereby reducing the number of parts and working time for assembling, rendering production of the aerosol container inexpensive.

The flow controller for aerosol container can be used for a compact aerosol container having a volume of 220 cc or less, or for a large size aerosol container having a volume of 1,000 cc or less. The contents that can be contained in the container in which the flow controller is used are, e.g., hair preparations, cosmetics, deodorants, antiperspirants, other human body treatment goods, insecticides, coating agents, cleaners, other goods for household, industrial materials, automobile goods, foods, etc.

As hair preparations, exemplified are, e.g., hair sprays, hair dresser-conditioner, hair shampoo and conditioner, acidic hair dyes, two liquids type oxidizing permanent hair dyes, color sprays, decoloring agents, permanent treatment agents, hair restorers, hair foams, hair tonics, sprays for bad hair correction, fragrances for hair, etc.

As cosmetics, exemplified are, e.g., shaving creams, after shave lotions, perfumes, eau de Cologne, facial cleansing materials, sun screens, foundations, unhair agents and decoloring agents, bath gels, toothpastes, skin care foams, etc.

As deodorants and antiperspirants, exemplified are, e.g., antiperspirants, deodorants, body shampoos, etc. As other human body treatment goods, exemplified are muscular antiphlogistics, skin disease treatments, dermatophytosis medicines, insect repellents, cleaners, oral agents, salves, burning medicines, etc.

As insecticides, exemplified are, e.g., air-spray insecticides, insecticides for cockroach, insecticides for gardening, insecticides for ticks, pesticides for noxious insects, etc. As coating agents, exemplified are, e.g., paints for house, paints for automobile, etc.

As cleaners, exemplified are glass cleaners for house, carpet cleaners, bath cleaners, floor and furniture cleaners, shoe and skin cleaners, wax cleaners, etc. As other goods for household, exemplified are, e.g., room deodorants, deodorants for toilet, waterproofing agents, starches for washing, herbicides, insecticides for clothes, flame proofing agents, fire extinguishers, antifungals, etc.

As industrial use, exemplified are, e.g., lubricants, anticorrosives, mold-releasing agents, etc. As automobile use, exemplified are, e.g., defrosting agents, antifreezing or thawing agents, engine cleaners, etc. As other uses, exemplified are, e.g., pet care goods, hobby goods, amusement goods, foods such as coffee, juices, etc.

The foregoing description of preferred embodiments of the invention has been presented for purposes of illustration and description, and is not intended to be exhaustive or to limit the invention to the precise form disclosed. The description was selected to best explain the principles of the invention and their practical application to enable others skilled in the art to best utilize the invention in various embodiments and various modifications as are suited to the particular use contemplated. It is intended that the scope of the invention not be limited by the specification, but the be defined claims set forth below.

What is claimed is:

1. A flow controller for an aerosol container to which a valve assembly is secured at a top inner surface of a container body for containing aerosol contents, the flow controller comprising:

a housing of the valve assembly, the housing cylindrically extending and having a hollow;

a piston slidably placed inside the housing to divide the hollow of the housing into an inlet side chamber and an outlet side chamber for the aerosol contents and pushed by elastic force from a spring toward the inlet side chamber for the aerosol contents, the piston having an introduction hole communicating between the inlet and outlet side chambers for the aerosol contents with respect to the piston;

a controlling sleeve cylindrically extending from the piston in the outlet side chamber and having a hollow, at a bottom of which the introduction hole is opened;

a cylinder extending cylindrically from a stem body of the valve assembly, placed coaxially with and in opposition to the controlling sleeve; and an insertion member cylindrically extending inside and coaxially with the cylinder, placed to form a insertion space between an outer round surface of the insertion member and an inner round surface of the cylinder, the insertion space allowing the controlling sleeve to slidably enter into the insertion space that forms an inner round passageway between an inner round surface of the controlling sleeve and the outer round surface of the insertion member and an outer round passageway between an outer round surface of the controlling sleeve and the inner round surface of the cylinder when the controlling sleeve enters the insertion space, the inner and outer round passageways being in communication of the aerosol contents with one another.

2. The flow controller according to claim 1, wherein the inner round passageway is formed of a groove axially extending on both or either of the outer round surface of the insertion member and the inner round surface of the controlling sleeve where the insertion member enters into the controlling sleeve in areal contact with the controlling sleeve.

3. The flow controller according to claim 1, wherein the inner round passageway is formed of a cylindrical clearance between the outer round surface of the insertion member and the inner round surface of the controlling sleeve.

4. The flow controller according to claim 1, wherein the outer round passageway is formed of a groove axially extending on both or either of the outer round surface of the controlling sleeve and the inner round surface of the cylinder where the controlling sleeve enters into the cylinder in areal contact with the cylinder.

5. The flow controller according to claim 1, wherein the outer round passageway is formed of a cylindrical clearance between the outer round surface of the controlling sleeve and the inner round surface of the cylinder.

6. The flow controller according to claim 1, wherein the stem body includes a cylindrical attachment member slidably inserted in the housing in areal contact with an inner round surface of the housing and an orifice through which the aerosol contents can be sprayed outside the aerosol container, and wherein a groove axially extending on an outer round surface of the attachment member at the areal contact between the attachment member and the housing is formed in capable of communicating with the orifice of the stem body to form a passageway for the aerosol contents at a space between the inner round surface of the housing and the outer round surface of the stem body.

7. The flow controller according to claim 1, wherein the stem body is capable of spraying the aerosol contents outside the aerosol container through an orifice of the stem body and includes a cylindrical attachment member slidably inserted in the housing in areal contact with an inner round surface of the housing, and wherein the attachment member has a circumferential collar extending axially at an outer circumference of the attachment member to allow the aerosol content to flow through a passage bore formed in a top of the attachment member to the orifice of the stem body.

* * * * *